US011268428B2

(12) United States Patent
Wolf et al.

(10) Patent No.: US 11,268,428 B2
(45) Date of Patent: Mar. 8, 2022

(54) INSULATING DEVICE FOR AN EXHAUST SYSTEM, EXHAUST SYSTEM, AND METHOD FOR PRODUCING AN INSULATING DEVICE

(71) Applicant: Faurecia Emissions Control Technologies, Germany GmbH, Augsburg (DE)

(72) Inventors: Roland Wolf, Kemnath (DE); Michel Rozet, Neusaess (DE); Stephan Welker, Feucht (DE)

(73) Assignee: Faurecia Emissions Control Technologies, Germany GmbH

( * ) Notice: Subject to any disclaimer, the term of this patent is extended or adjusted under 35 U.S.C. 154(b) by 1051 days.

(21) Appl. No.: 15/475,252

(22) Filed: Mar. 31, 2017

(65) Prior Publication Data

US 2017/0284272 A1 Oct. 5, 2017

(30) Foreign Application Priority Data

Apr. 4, 2016 (DE) ..... 10 2016 106 125.5

(51) Int. Cl.
*F01N 13/14* (2010.01)
*F01N 13/18* (2010.01)

(52) U.S. Cl.
CPC ..... *F01N 13/14* (2013.01); *F01N 13/1888* (2013.01); *F01N 2450/22* (2013.01)

(58) Field of Classification Search
CPC .. F01N 13/14; F01N 13/1888; F01N 2450/22; F01L 9/02; F01L 9/17;
(Continued)

(56) References Cited

U.S. PATENT DOCUMENTS 3,783,497 A * 1/1974 Griesinger ..... B21C 37/06 29/460
3,903,928 A * 9/1975 Sykes ..... F16L 59/153 138/109
(Continued)

FOREIGN PATENT DOCUMENTS

DE 3821468 12/1989
DE 19825762 12/1998
(Continued)

OTHER PUBLICATIONS

Search Report from German counterpart application dated Feb. 1, 2017, plus English summary.

*Primary Examiner* — Devon C Kramer
*Assistant Examiner* — Kelsey L Stanek
(74) *Attorney, Agent, or Firm* — Carlson, Gaskey & Olds, P.C.

(57) ABSTRACT

An insulating device for a thermal and/or acoustic insulation of an exhaust system of a vehicle has a first half shell including at least a first connection rim and a second half shell including at least a second connection rim, the first half shell and the second half shell being connected by a welded joint at the connection rims. The connection rims are reshaped into a multiple fold. Further disclosed are a vehicle exhaust system having an exhaust gas-carrying duct and an insulating device circumferentially surrounding the duct, as well as a method for producing an insulating device for a thermal and/or acoustic insulation of an exhaust system of a vehicle.

11 Claims, 5 Drawing Sheets

(58) Field of Classification Search
CPC ..... F01L 9/21; B21D 39/02; B21D 39/04; B21D 39/046; B21D 5/16; B21D 39/026; B21D 39/028; B21D 39/048; B23K 26/22; Y10T 29/49966; Y10T 29/49968
USPC ..... 60/320; 138/149, 171, 163, 167, 169; 59/24; 29/890.08, 505–521; 219/121.64, 219/91.23
See application file for complete search history.

(56) References Cited

U.S. PATENT DOCUMENTS 4,333,545 A * 6/1982 Roberts ..... F01N 13/185 138/151
4,851,298 A * 7/1989 Fukuda ..... F01N 13/185 428/586
5,233,832 A 8/1993 Moore, III
5,916,137 A 6/1999 Hayashi
6,158,547 A * 12/2000 Ackermann ..... F01N 1/24 181/256
2012/0273174 A1 11/2012 Barnes
2014/0020785 A1* 1/2014 Blueml ..... B21D 39/048 138/148
2018/0170594 A1* 6/2018 Speck ..... B65B 11/50

FOREIGN PATENT DOCUMENTS

DE 202008008690 U1 * 9/2008 ..... B60R 13/0838
DE 202008008690 10/2008
DE 102010025554 12/2011
DE 102010025554 A1 * 12/2011 ..... F16L 58/1054
EP 0556262 A1 8/1993
EP 2667073 A1 * 11/2013 ..... B21D 39/02
FR 2906307 A1 3/2008
FR 2913058 A1 8/2008

* cited by examiner

INSULATING DEVICE FOR AN EXHAUST SYSTEM, EXHAUST SYSTEM, AND METHOD FOR PRODUCING AN INSULATING DEVICE

CROSS-REFERENCE TO RELATED APPLICATIONS

This application claims priority to DE 10 2016 106 125.5, filed Apr. 4, 2016.

FIELD OF THE INVENTION

The present invention relates to an insulating device for a thermal and/or acoustic insulation of an exhaust system of a vehicle. The device has a first half shell including at least a first connection rim and a second half shell including at least a second connection rim, the first half shell and the second half shell being attached to each other at the connection rims.

In addition, the present invention relates to a vehicle exhaust system having an exhaust gas-carrying duct and an insulating device circumferentially surrounding the duct.

The present invention further relates to a method for producing an insulating device for a thermal and/or acoustic insulation of an exhaust system of a vehicle. The device has a first half shell including at least a first connection rim and a second half shell including at least a second connection rim.

BACKGROUND

It is known in the prior art to provide exhaust systems for vehicles that include, e.g., catalytic converters, diesel particulate filters, mufflers and/or exhaust pipes, with insulating devices. The insulating devices thermally and/or acoustically insulate the components of the exhaust system from an environment. Furthermore, the insulating devices are beneficial to a rapid heating up of, e.g., catalytic converters or diesel particulate filters in the warm-up phase of the vehicle. In this way, the necessary operating temperature for the catalytic converters and the diesel particulate filters is reached faster and the associated efficiency is increased.

The insulating devices are usually made from half shells enclosing the components of the exhaust system which are to be insulated. The half shells are connected with each other by the most varied of methods such as, e.g., welding, clinching, folding or lock seaming.

DE 38 21 468 A1 discloses an insulating device for an exhaust system which can be attached in particular to an exhaust pipe section or a catalytic converter. An insulating mat is placed around an exhaust section and is held by two half shells of a metallic mesh which are connected with each other by the ends of the lower half shell being folded over. To provide protection against moisture, a film or foil may be arranged between the insulating mat and the mesh.

Basically, the aim is always to manufacture insulating devices for vehicle exhaust systems, and vehicle exhaust systems provided with insulating devices, as simply and cost-efficiently as possible. At the same time, the insulating devices and vehicle exhaust systems are intended to take up only a small amount of installation space.

Due to the fact that the presence of water in an insulating device of a vehicle exhaust system significantly reduces the insulating effect, insulating devices are sealed against the ingress of water. Such sealing also needs to be effective when a vehicle passes through water, as can be done by an SUV, for example, and when there is a heavy impact of splash water.

The object of the present invention therefore is to provide an insulating device which can be manufactured cost-efficiently and simply while it is highly watertight.

SUMMARY

The present invention provides a generic insulating device in which a first half shell and a second half shell are connected by a welded joint at first and second connection rims, and the connection rims are reshaped into a multiple fold. Here, a multiple fold is defined by the presence of more than the simple folding of only one connection rim, i.e. by at least a simple hemming or folding over of both connection rims. The multiple folding creates a very tight connection of the half shells. Furthermore, the multiple fold also allows very thin half shells to be connected, where a simple fold would not exhibit the required stability. The prior welding process causes the half shells to be positioned in relation to each other, so that folding can be effected with higher precision and the connection rims will not yawn relative to each other at the ends. This is of advantage in particular in the case of very thin half shells.

One embodiment of the invention provides that both connection rims are folded, i.e. bent, more particularly are bent jointly.

The basic idea of the present invention is to make use of very thin half shells, which preferably have a wall thickness of less than 0.2 mm, in an insulating device of an exhaust system of a vehicle, considering that a thin wall thickness always results in a low weight and a simple and cost-efficient processing. In order that a precise positioning and a tight interlocking when folding the half shells can also be ensured with very thin half shells, they are welded to each other. In addition, the connection rims of the half shells are reshaped into a multiple fold which, compared with a simple fold, increases the tightness.

According to one embodiment, the half shells are spot welded at their connection rims. In contrast to a continuous line welding, in this way very thin half shells or half shells having very thin connection rims may also be welded and thus be fixed in place relative to each other.

A further development provides that the multiple fold comprises a first portion in which the two connection rims extend substantially parallel and in particular flat and are welded. Preferably, the connection rims are in direct surface contact with each other. The welded joint is located inside the multiple fold here. Therefore, the insulating device requires only a small amount of installation space.

Advantageously, the multiple fold comprises a second portion in which the two connection rims extend substantially parallel, and in particular flat, with the second portion facing the first portion substantially in parallel and preferably contacting the first portion, and/or preferably being disposed further away from the free ends of the connection rims than the first portion. This means that, proceeding from the free ends of the connection rims, the first portion is located in front of the second portion. Therefore, in a sectional view of the first and second portions, four layers of material of the connection rims lie one on top of the other.

Preferably, the multiple fold comprises a third portion in which the two connection rims extend substantially in parallel, the third portion connecting the first and second portions, the connection rims each being bent by substantially 180° in the third portion to form the multiple fold. In this way, a multiple fold is produced which has a high tightness and stability and in which the connection rims, resting against each other, of the half shells are jointly bent and folded. This allows very thin connection rims or very thin half shells to be processed as well.

Preferably, the connection rims have substantially the same length.

In addition, the half shells may form a pipe, and the connection rim may protrude outward from the pipe. In particular, a free end of a connection rim may, preferably tangentially, contact the outside of the pipe formed by the half shells. The connection rim may protrude outward from the pipe obliquely or at right angles. When the connection rims are folded over by 180°, the free ends thereof point at the pipe. Positioning the free ends in this way allows a simple and safe handling and assembly of the insulating device since thus there are no sharp edges that may protrude from the pipe. Moreover, the tightness is increased by having a further fold.

As an alternative, the half shells may form a pipe and the multiple fold may be oriented tangentially with respect to the outside of the pipe. That is, the multiple fold and the first and second portions thereof extend substantially perpendicularly to a connecting plane of the half shells. The multiple fold requires only a very small amount of installation space.

The first half shell and the second half shell are preferably shaped from a metal foil or sheet metal which preferably have a maximum wall thickness of 0.2 mm. As a result, the half shells are very thin and very light-weight and can be reshaped and worked in a simple manner.

An additional object of the invention resides in providing a vehicle exhaust system which includes an insulating device exhibiting a high water tightness and which is cost-efficient to produce.

The object is further achieved by a generic vehicle exhaust system, the insulating device being designed in the manner set forth above, and an insulating material being disposed between the half shells and the duct.

A further object of the invention resides in providing a method for producing an insulating device for a thermal and/or acoustic insulation of an exhaust system of a vehicle.

The object is achieved by a method of the type initially mentioned, including the steps of attaching the first and second half shells to each other by welding the first and second connection rims; and subsequently bending the first and second connection rims to form a multiple fold.

In one embodiment, in step (a) the two connection rims contacting each other and protruding substantially radially from their half shells are welded together, preferably by resistance spot welding.

In addition, a further development of the method provides that step (b) comprises bending the welded connection rims by substantially 180°, a pipe being formed by the half shells, and the connection rims including a first portion originating from the free ends of the connection rims as well as a second portion contacting the first portion as well as a third portion connecting the first and second portions and bent by substantially 180°. Thus, a multiple fold having three portions is generated, in which the first portion is bent by 180° in relation to the second portion.

Preferably, following step (b) at least one of the connection rims is angled at its free end, and the inner connection rim is placed in position, preferably tangentially placed in position, against the outside of a pipe formed by the half shells at the free end.

In one variant, prior to step (a) an insulating material is disposed between the first and second half shells and a component of the exhaust system.

Preferably, the entire method is performed in a single clamping of the half shells and within a single tool. Therefore, any reclamping or tool changes are not necessary.

According to one embodiment, the radially protruding connection rims contacting each other are angled between two clamping surfaces extending obliquely with respect to a connecting plane of the half shells, one of the clamping surfaces being formed by a first slide feed and an opposing one of the clumping surfaces being formed by a stopper part. The clamping surfaces subsequently continue to clamp this portion of the connection rims, and a second slide feed bends the part of the connection rims protruding with regard to the clamping surfaces before a rail presses the bent, protruding part against the portion of the connection rims previously held between the clamping surfaces with the first and second slide feeds removed. This means that the method proceeds within a single tool without reclamping or retooling.

These and other features may be best understood from the following drawings and specification.

DETAILED DESCRIPTION

Figure 1:
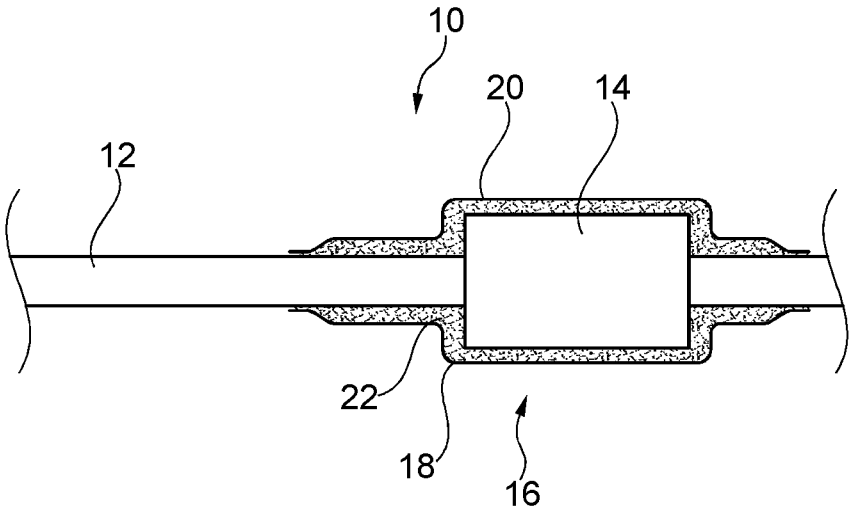
FIG. 1 shows a vehicle exhaust system according to the invention with an insulating device according to the invention in accordance with a first embodiment of the vehicle exhaust system.

As can be seen in FIG. 1, a vehicle exhaust system 10 substantially comprises an exhaust gas-carrying duct 12 and a functional element 14 which is only schematically illustrated in FIG. 1. The functional element 14 may be a diesel particulate filter, a catalytic converter or a muffler, for example.

The vehicle exhaust system 10 is provided with a thermal and/or acoustic insulating device 16 which encloses the duct 12 and the functional element 14 in sections. For reasons of clarity, the insulating device 16 is illustrated in a sectional view and comprises two half shells 18, 20.

An insulating material 22 is disposed between the half shells 18, 20 and the duct 12 and also between the half shells 18, 20 and the functional element 14.

Figure 2:
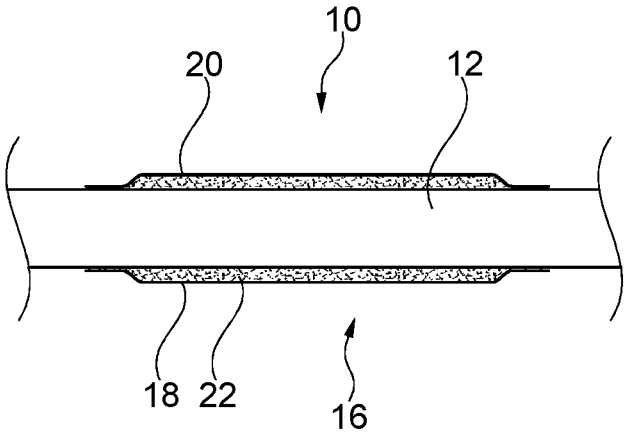
FIG. 2 shows a vehicle exhaust system according to the invention with an insulating device according to the invention in accordance with a second embodiment of the vehicle exhaust system.

FIG. 2 shows an alternative embodiment of the vehicle exhaust system 10, in which only the exhaust gas-carrying duct 12 is present. The functional element 14 is not provided. The structure of the insulating device 16 corresponds to that of FIG. 1 here, the insulating device 16 being adapted to the outer contour of the duct 12.

FIGS. 3 to 6 illustrate different embodiments of the insulating device 16. For reasons of clarity, the two half shells 18, 20 are shown only partly; at the other, left-hand end, they are formed symmetrically with the right-hand end illustrated.

In all of the embodiments of the insulating device 16, it comprises the two half shells 18, 20, which are connected with each other in a connecting plane E.

A connection rim 28 is integrally formed with both opposite edges of the half shell 18, and a connection rim 30 is integrally formed with both opposite edges of the half shell 20, the connection rim protruding laterally from the half shell 18, 20.

The connection rims 28, 30 are connected with each other by a welded joint 24. In the illustrated embodiments of the insulating device 16, the welded joint 24 is in the form of a spot weld.

Additionally, in all embodiments of the insulating device 16, the connection rims 28, 30 are reshaped such that they form a multiple fold 32. The multiple fold 32 comprises three portions.

In a first portion 34 of the multiple fold 32, which starts from the free edges 38, 40 of the connection rims 30 and 28, respectively, the two connection rims 28, 30 extend to be substantially parallel and flat. In this first portion 34, the welded joint 24 is also located.

In a second portion 36 of the multiple fold 32, the connection rims 28, 30 also extend to be parallel and flat. The second portion 36 here faces the first portion 34 substantially in parallel and is directly adjacent to the pipe formed by the half shells. Preferably, the second portion 36 is in direct contact with the first portion 34. For reasons of clarity, a small distance between the first portion 34 and the second portion 36 is depicted in the figures.

The second portion 36 is further away from free ends 38, 40 of the connection rims 30 and 28, respectively, than the first portion 34.

Furthermore, the multiple fold 32 comprises a third portion 42. The connection rims 28, 30 extend substantially parallel in the third portion 42 as well. The third portion 42 connects the first portion 34 with the second portion 36. To this end, the connection rims 28, 30 are bent by substantially 180° in the third portion 42.

In other words, in the third portion 42 the connection rims 28, 30 are folded down once, so that the first portion 34 and the second portion 36 lie directly on top of each other.

The first portion 34, the second portion 36, and the third portion 42 together form the multiple fold 32.

Figure 3:
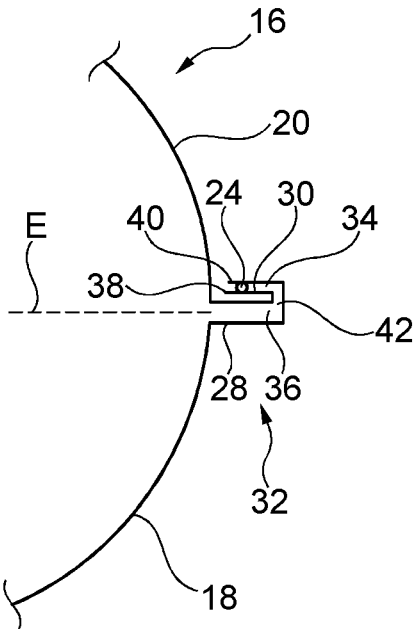
FIG. 3 shows one example embodiment of the insulating device according to the invention.
Figure 6:
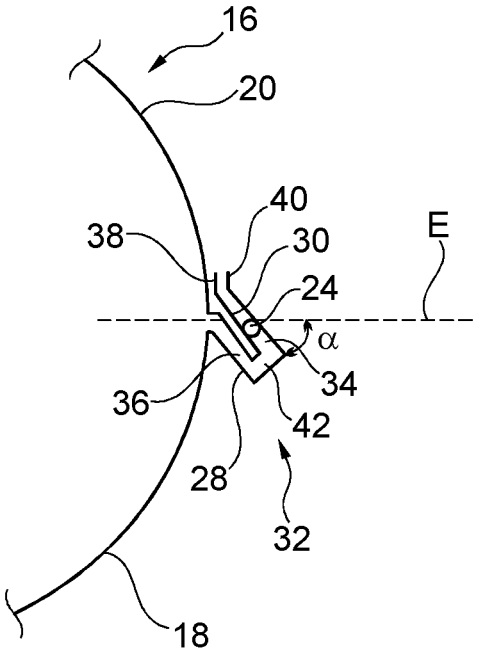
FIG. 6 shows another example embodiment of the insulating device according to the invention.

According to the embodiments shown in FIG. 3 and FIG. 6, the multiple fold 32 projects from the geometry formed by the half shells 18, 20. In the illustrated embodiments, the geometry formed by the half shells 18, 20 is a pipe geometry.

The multiple fold 32 may either project perpendicularly from the pipe geometry, as shown in FIG. 3, or may project obliquely from the pipe geometry at an angle, as shown in FIG. 6.

The angle at which the multiple fold 32 projects from the pipe geometry may be freely selected here. It is preferred, however, as illustrated in FIG. 6, that the multiple fold 32 includes an angle $\alpha$ of approx. 30° with the connecting plane E of the half shells 18, 20 in the area of the connection rims.

Figure 4:
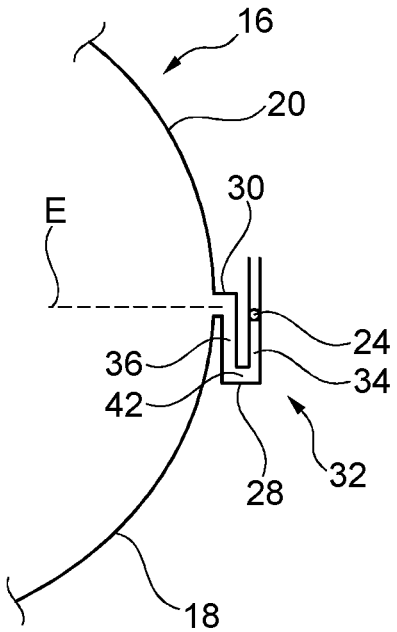
FIG. 4 shows another example embodiment of the insulating device according to the invention.
Figure 5:
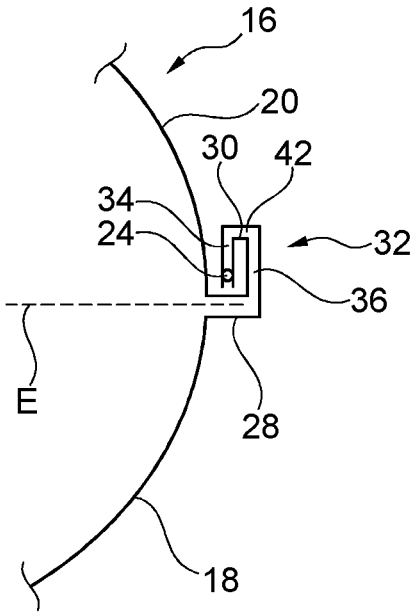
FIG. 5 shows another example embodiment of the insulating device according to the invention.

In the embodiments shown in FIG. 4 and FIG. 5, the multiple fold 32 does not project from the geometry formed by the half shells 18, 20, but is oriented tangentially to this geometry. The half shells 18, 20 constitute a pipe geometry in FIG. 4 and FIG. 5 as well.

The embodiments of FIG. 4 and FIG. 5 differ by the direction in which the multiple fold 32 is oriented tangentially to the pipe geometry.

Proceeding from the configuration shown in FIG. 3, the embodiment according to FIG. 4 is obtained by additionally bending the multiple fold 32 down by substantially 90°.

The embodiment according to FIG. 5 is obtained proceeding from the configuration of FIG. 3 by bending the multiple fold 32 up by substantially 90°.

In the embodiments of FIGS. 4 and 5, the multiple fold 32 is oriented perpendicularly to a connecting plane E of the half shells 18, 20.

In addition to the multiple fold 32 as a whole, the free ends 38, 40 of the half shells 18, 20 may also be aligned and angled. This is illustrated in FIG. 6. The free ends 38, 40 are placed in an angled shape against the outside of the pipe geometry formed by the half shells 18, 20. In the example illustrated, the free ends 38, 40 are placed tangentially against the outside of the pipe.

Placing the free ends 38, 40 in such a way is illustrated only in FIG. 6, but can be adopted for the embodiments shown in FIG. 3 to FIG. 5.

The method for producing an insulating device 16 will be explained with reference to method steps illustrated in FIGS. 7 to 11.

For carrying out the method, a device is made use of which is in the form of a tool, for example, and comprises a stopper part 44 and a holding down clamp 46. The stopper part 44 and the holding down clamp 46 hold the two half shells 18, 20 while the process is in progress. In addition, the device comprises a first slide feed 48, a second slide feed 50, and a rail 52 that are used to produce the multiple fold 32.

Figure 7:
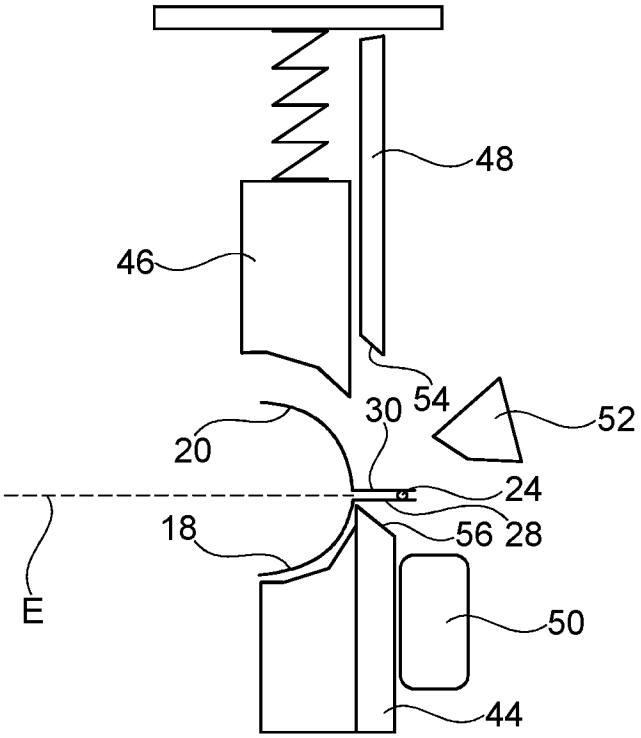
FIG. 7 shows one step of a variant of the method according to the invention for producing an insulating device.

In the intermediate state of the process as illustrated in FIG. 7, the two half shells 18, 20 have already been connected by the welded joint 24 at their flat connection rims 28, 30 protruding perpendicularly to the shell portion. The connected half shells 18, 20 have been placed in the device and contact the stopper part 44.

Figure 8:
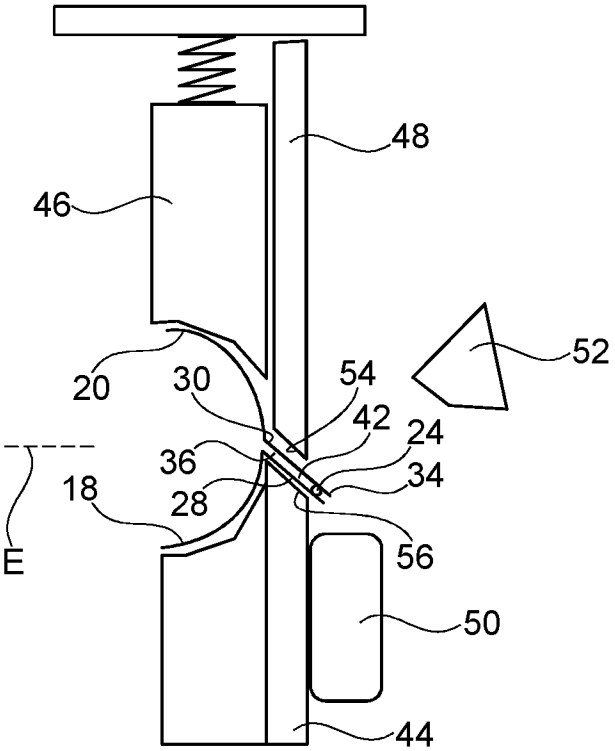
FIG. 8 shows another step of a variant of the method according to the invention for producing an insulating device.

As is visible in FIG. 8, the half shells 18, 20 are then firmly held by the holding down clamp 46 and the stopper part 44.

Then, the first slide feed 48 is moved such that, in cooperation with the stopper part 44, it clamps and bends the two connection rims 28, 30. To this end, a clamping surface 54 is disposed on the first slide feed 48, and a clamping surface 56 is disposed on the stopper part 44. Both clamping surfaces 54, 56 are disposed substantially at that angle at which the two connection rims 28, 30 are to be bent. This means that the clamping surfaces 54, 56 are inclined with respect to the connecting plane E.

In FIG. 8, the first slide feed 48 and the stopper part 44 clamp the second portion 36 of the multiple fold 32 (see also FIGS. 3 to 6). In FIG. 8, the first portion 34 and the third portion 42 of the multiple fold 32 protrude to the right beyond the clamping surface 54 of the first slide feed 48 and the clamping surface 56 of the stopper part 44.

Figure 9:
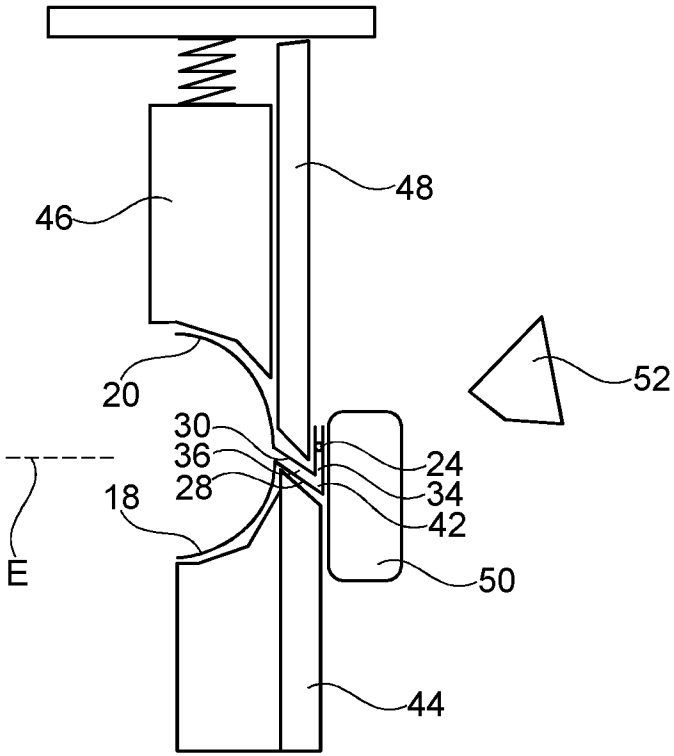
FIG. 9 shows another step of a variant of the method according to the invention for producing an insulating device.

As can be seen in FIG. 9, the protruding first portion 34 and the third portion 42 of the multiple fold 32 are subsequently bent by the second slide feed 50, which moves in the opposite direction to the feed motion of the first slide feed 48.

In the process, the first portion 34, which also comprises the welded joint 24, is bent up laterally against the first slide feed 48. The actual bending process takes place here in the third portion 42 of the connection rims 28, 30.

Figure 10:
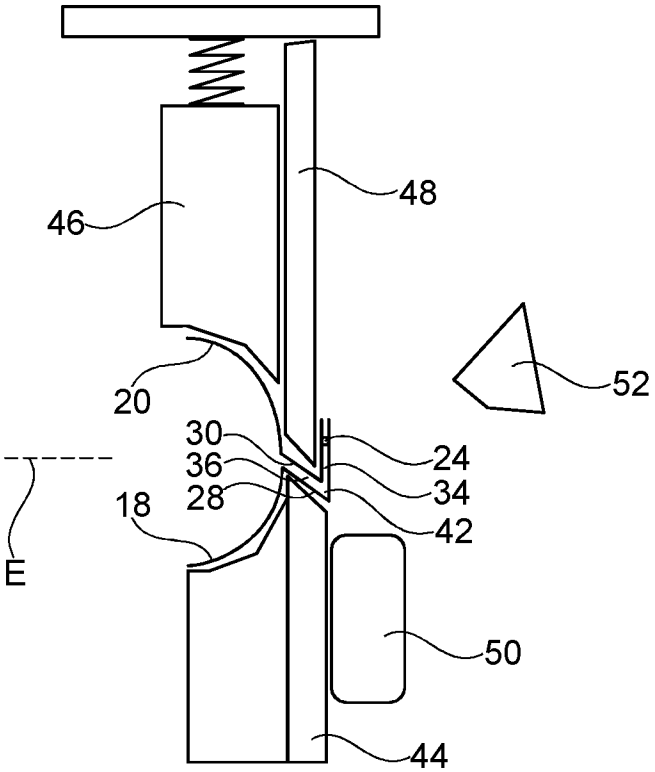
FIG. 10 shows another step of a variant of the method according to the invention for producing an insulating device.

As is illustrated in FIG. 10, following this bending action, the second slide feed 50 returns to its initial position again.

Figure 11:
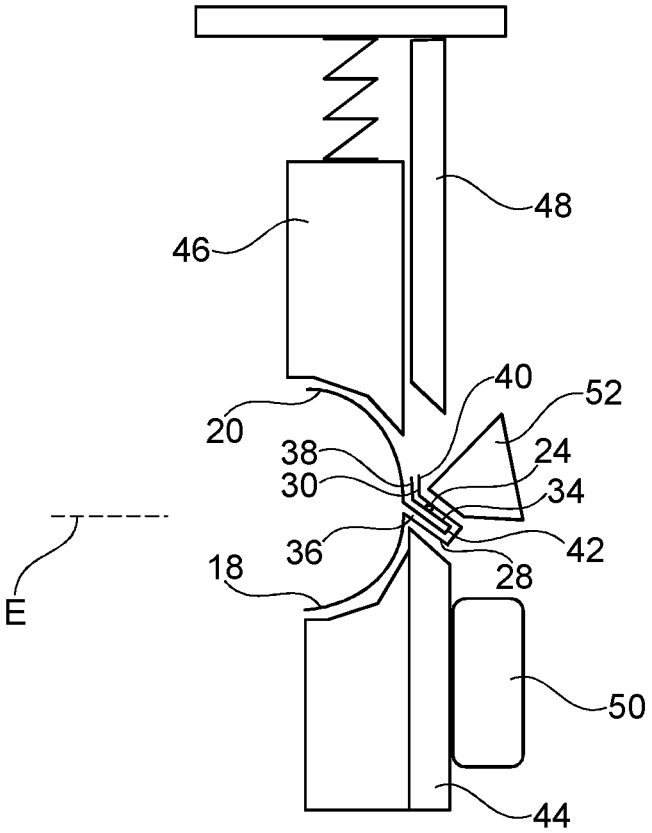
FIG. 11 shows another step of a variant of the method according to the invention for producing an insulating device.

The first slide feed 48 also returns to its initial position, as can be seen in FIG. 11.

Thereafter, the rail 52 moving toward the multiple fold 32 from the outside and obliquely from above further bends the first portion 34 so that the latter contacts the second portion 36. As is apparent from FIG. 11, the third portion 42 is then bent by substantially 180°.

Additionally, the ends 38, 40 of the connecting portions are placed by the rail 52 against the geometry formed by the half shells 18, 20.

The ends 38, 40 then extend tangentially to the outside of the pipe formed by the half shells 18, 20.

As is apparent when FIGS. 7 to 11 are viewed in combination, the method for producing an insulating device 16 proceeds in a single clamping and within a single tool.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. A method for producing an insulating device for at least one of a thermal and acoustic insulation of an exhaust system of a vehicle, comprising a first half shell having at least a first connection rim and a second half shell having at least a second connection rim, wherein the first half shell and the second half shell have a wall thickness of less than 0.2 mm, the method comprising the steps of:

(a) attaching the first and second half shells to each other by spot welding the first and second connection rims; and (b) subsequently bending the first and second connection rims to form a multiple fold, wherein the first and second connection rims are bent at the same time, and wherein following step (b) at least one of the first and second connection rims is angled at a free end, and an inner one of the first connection rim and the second connection rim is placed in position against an outside of a pipe formed by the first and second half shells at the free end.

2. The method according to claim 1, wherein in step (a) the first and second connection rims contact each other and protrude radially from the first and second half shells that are welded together.

3. The method according to claim 1, wherein step (b) comprises bending welded first and second connection rims by 180°, and the first and second connection rims comprise a first portion originating from free ends of the first and second connection rims as well as a second portion contacting the first portion as well as a third portion connecting the first and second portions and bent by 180°.

4. The method according to claim 1, wherein prior to step (a) an insulating material is disposed between the first and second half shells and a component of the exhaust system.

5. The method according to claim 1, wherein the entire method is performed in a single clamping of the first and second half shells and within a single tool.

6. The method according to claim 1, wherein the free end extends at an obtuse angle relative to an external surface of the pipe subsequent to step (b).

7. The method according to claim 1, wherein the first and second half shells have an external surface defined by an outermost dimension, and wherein the free end extends outward beyond the external surface subsequent to step (b).

8. A method for producing an insulating device for at least one of a thermal and acoustic insulation of an exhaust system of a vehicle, comprising a first half shell having at least a first connection rim and a second half shell having at least a second connection rim, comprising the steps of:

(a) attaching the first and second half shells to each other by spot welding the first and second connection rims;

(b) subsequently bending the first and second connection rims to form a multiple fold, wherein the first and second connection rims are bent at the same time; and wherein radially protruding first and second connection rims contacting each other are angled between two clamping surfaces extending obliquely with respect to a connecting plane of the first and second half shells, one of the two clamping surfaces being formed by a first slide feed and an opposing one of the two clamping surfaces being formed by a stopper part, the two clamping surfaces subsequently continue to clamp a portion of the first and second connection rims, and a second slide feed bends a part of the first and second connection rims protruding with regard to the two clamping surfaces before a rail presses the bent and protruding part against the portion of the first and second connection rims which was previously held between the two clamping surfaces with the first and second slide feeds removed.

9. A method for producing an insulating device for at least one of a thermal and acoustic insulation of an exhaust system of a vehicle, comprising a first half shell having at least a first connection rim and a second half shell having at least a second connection rim, wherein the first half shell and the second half shell have a wall thickness of less than 0.2 mm, the method comprising the steps of:

(a) attaching the first and second half shells to each other by spot welding the first and second connection rims; and (b) subsequently bending the first and second connection rims to form a multiple fold, wherein the first and second connection rims are bent at the same time, wherein following step (b) at least one of the first and second connection rims is angled at a free end, and an inner one of the first connection rim and the second connection rim is placed in position against an outside of a pipe formed by the first and second half shells at the free end.

10. The method according to claim 9, wherein the free end extends at an obtuse angle relative to an external surface of the pipe subsequent to step (b).

11. The method according to claim 9, wherein the first and second half shells have an external surface defined by an outermost dimension, and wherein the free end extends outward beyond the external surface subsequent to step (b).

* * * * *